US005226698A

United States Patent [19]

Harrison

[11] Patent Number: 5,226,698

[45] Date of Patent: Jul. 13, 1993

[54] HARNESS FOR SECURING AN OBJECT TO A SUPPORT AND METHOD OF USE THEREOF

[76] Inventor: Betty L. Harrison, P.O. Box 67552, Station "O", Vancouver, British Columbia, Canada

[21] Appl. No.: 788,166

[22] Filed: Nov. 5, 1991

[51] Int. Cl.[5] ..... A47D 13/08

[52] U.S. Cl. ..... 297/485; 297/464; 297/467

[58] Field of Search ..... 297/224, 254, 255, 256, 297/464, 465, 466, 467, 470, 471, 485, 483, 484

[56] References Cited

U.S. PATENT DOCUMENTS

| | | | |
|---|---|---|---|
| 1,429,867 | 9/1922 | Goldsmith . | |
| 2,875,816 | 3/1959 | Langefeld . | |
| 2,960,149 | 11/1960 | Throssel . | |
| 3,136,581 | 6/1964 | Caballero | 297/465 |
| 3,186,762 | 6/1965 | Lucas . | |
| 3,301,594 | 1/1967 | Pukish, Jr. | 297/467 |
| 3,529,864 | 9/1970 | Rose et al. | 297/467 |
| 3,828,994 | 8/1974 | Hollins . | |
| 4,205,670 | 6/1980 | Owens | 297/485 X |
| 4,235,474 | 11/1980 | Roseberg . | |
| 4,402,548 | 9/1983 | Mason . | |
| 4,702,523 | 10/1987 | Schrader et al. | 297/467 X |
| 4,834,460 | 5/1989 | Herwig | 297/467 X |
| 4,927,211 | 5/1990 | Bolcerek | 297/467 X |

FOREIGN PATENT DOCUMENTS

| | | | |
|---|---|---|---|
| 649206 | 5/1985 | Switzerland | 297/467 |
| 1314321 | 4/1973 | United Kingdom | 297/484 |

*Primary Examiner*—Peter R. Brown

*Attorney, Agent, or Firm*—Bull, Housser & Tupper

[57] ABSTRACT

A harness for securing an object to a support comprises a flexible longitudinal strap member having first and second opposite end portions and an intermediate portion between the end portions. First and second strap portions having respective inner portions and respective outer end portions, are connected to the intermediate portion such that the first and second strap portions extend transversely to the longitudinal member. Connectors are provided for connecting respective outer end portions of the first and second strap portions to the first end portion of the longitudinal member to form a cradle. Third and fourth strap portions having respective inner portions and respective outer end portions are also connected to the intermediate portion such that the third and fourth strap portions extend transversely to the longitudinal member. Connectors are provided for connecting together respective outer end portions of the third and fourth strap portions to secure same about an object. A stretchable elastic loop is connected to the second end portion of the longitudinal member. The loop is operable to receive the support therein such that the support extends through the loop and such that the loop embraces the support.

18 Claims, 3 Drawing Sheets

HARNESS FOR SECURING AN OBJECT TO A SUPPORT AND METHOD OF USE THEREOF

BACKGROUND OF THE INVENTION

This invention relates to devices for securing an object to a support, and more particularly relates to a harness for securing a child in a conventional chair. The invention also relates to a method of using a harness to secure an object to a support, and more particularly relates to a method of using a harness to secure a child in a chair.

Numerous devices and methods have been proposed for retaining an object or child in a conventional chair. U.S. Pat. No. 4,235,474 to Rosenberg discloses one such device. The Rosenberg device has a pocket which fits over a back portion of a chair and has a baby holding section having two ties which are used to tie a baby to the chair. The Rosenberg device may be useful however, it does not appear to accommodate chairs with back portions of different sizes and it requires that a knot be undone when the baby is to be removed from the chair. The removal of a knot can be time consuming in the event that the child must be removed in an emergency.

Other U.S. patents such as U.S. Pat. Nos. 1,429,867 to Goldsmith; 2,875,816 to Langefeld; 2,960,149 to Throssel; 3,186,762 to Lucas; 3,828,994 to Hollins; and 4,402,548 to Mason relate generally to devices which incorporate a separate seat for the child to sit on or relate to a belt arrangement for securing a conventional child seat to an automobile seat. Hollins discloses an apparatus for transporting articles on a automobile seat however no provisions appear to be provided for securing a child rather than articles to the seat.

The invention disclosed herein provides an advance in the art by providing a harness which can be used to secure objects, in general, to a support such as a chair having virtually any size of back portion and provides a harness which is versatile enough to harness a child to such a chair. Moreover, the harness is adapted to be comfortable to the child while permitting easy removal of the child from the harness thereby reducing risk of injury to the child in the event of an emergency.

SUMMARY OF THE INVENTION

The invention provides a harness for securing an object to a support, the harness comprising a flexible longitudinal strap member having first and second opposite end portions and an intermediate portion between the end portions. First and second strap portions having respective inner portions and respective outer end portions, are connected to the intermediate portion such that the first and second strap portions extend transversely to the longitudinal member. Connectors are provided for connecting respective outer end portions of the first and second strap portions to the first end portion of the longitudinal member to form a cradle. Third and fourth strap portions having respective inner portions and respective outer end portions are also connected to the intermediate portion such that the third and fourth strap portions extend transversely to the longitudinal member. Connectors are provided for connecting together respective outer end portions of the third and fourth strap portions to secure same about an object. A stretchable elastic loop is connected to the second end portion of the longitudinal member. The loop is operable to receive the support therein such that the support extends through the loop and such that the loop embraces the support.

The harness may be used to secure an object, in general, to an upstanding support such as a chair by using the elastic loop to secure the longitudinal member to a back portion of the chair, looping the first and second strap portions around the object, looping the first end portion of the longitudinal member under the object and connecting the first end portion to the first and second strap portions. Optionally, the third and fourth strap portions may also be wrapped around the object and outer end portions thereof connected together.

Preferably, when the harness is used to secure a child, the first and second strap portions and the first end portion of the longitudinal member are operable to form a cradle extending about the child's waist and crotch.

Also preferably, when the harness is used to secure a child the third and fourth strap portions are operable to be adjustably positioned both longitudinally and transversely of the longitudinal member to place the third and fourth strap portions comfortably about the upper torso of the child.

In using the harness to secure a child to a chair, a back portion of the chair is passed through the elastic loop such that the elastic loop embraces the back portion of the chair. An end portion of the longitudinal strap member is then placed on a seat portion of the chair. The child is then placed on the end portion such that the end portion is disposed between the seat portion and the child. The end portion is then moved upwards between the child's legs and the first and second strap portions are wrapped around the waist of the child. The first and second strap portions are then connected to the upwardly extending end portion of the longitudinal strap member and the third and fourth strap portions are wrapped around the upper torso of the child. The end portions of the third and fourth strap portions are then connected together.

DISCLOSURE

Figure 1:
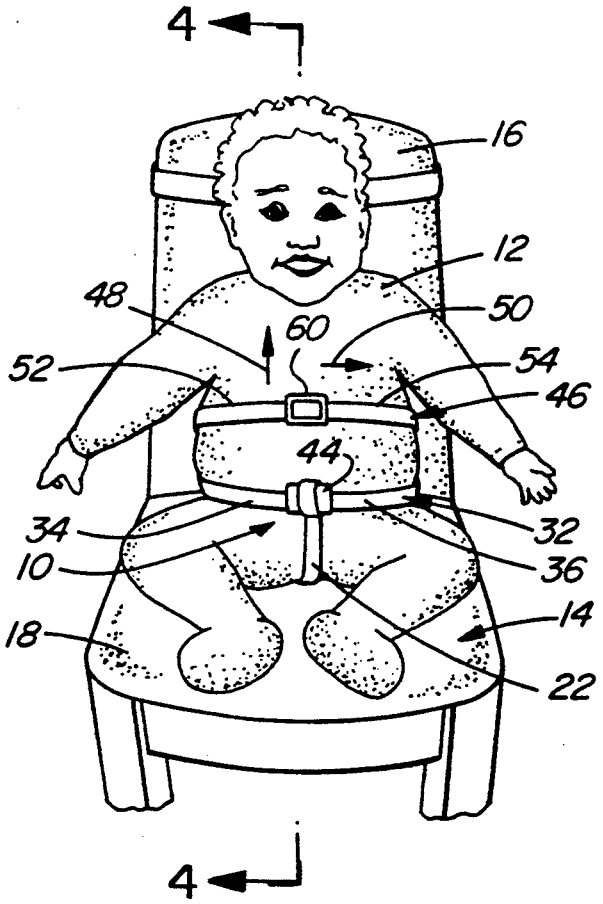
FIG. 1 is a perspective view of a harness according to a first embodiment of the invention, the harness being shown securing a child in a chair.

Referring to FIG. 1, a harness 10 according to a first embodiment of the invention is shown restraining a child 12 in a chair 14. The harness is secured to a back portion 16 of the chair and serves to retain the child on a seat portion 18 of the chair.

Figure 2:
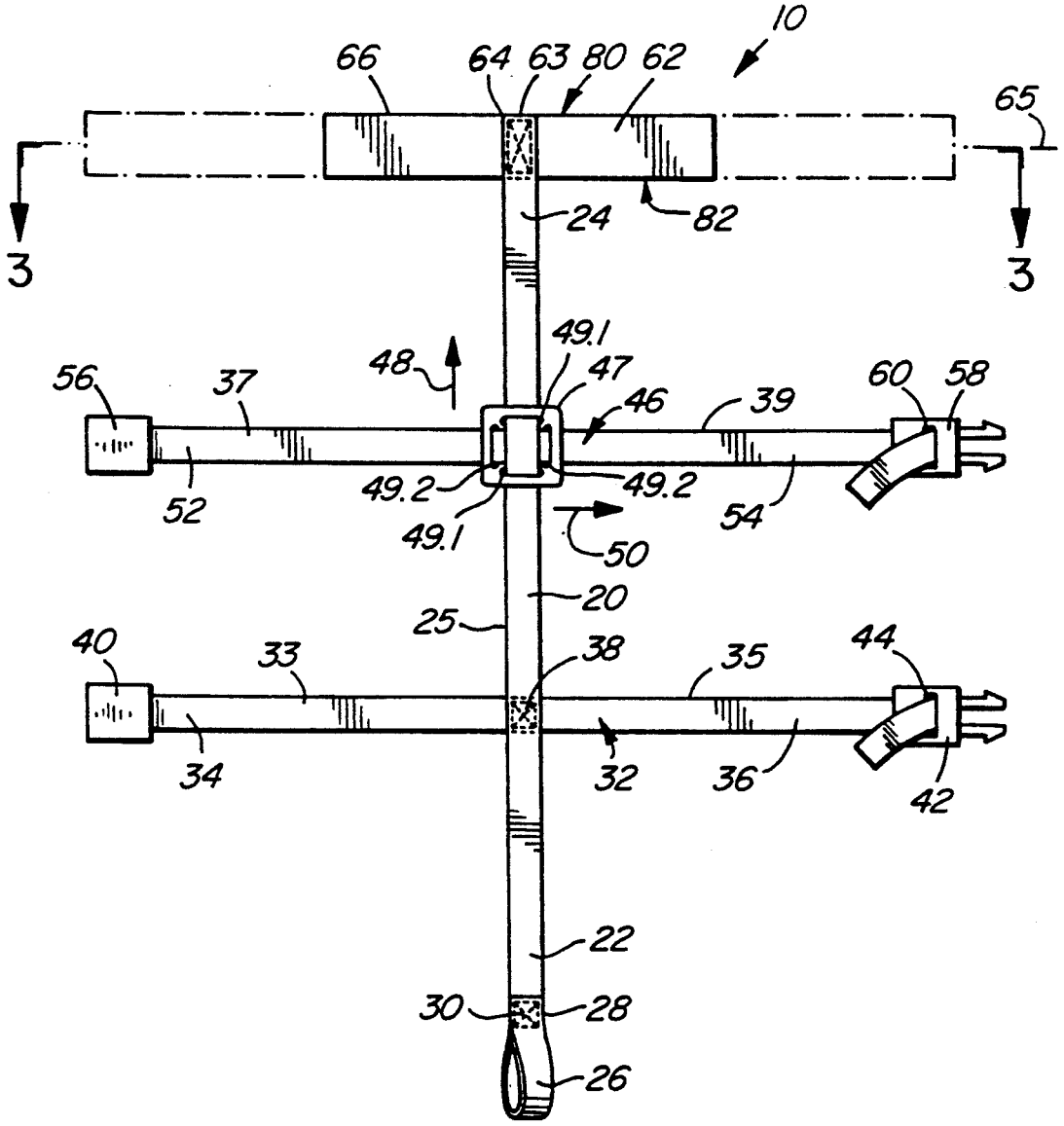
FIG. 2 is a plan view of the harness of FIG. 1.

Referring to FIG. 2, the harness, shown generally at 10 comprises a flexible longitudinal member 20 having first and second opposite end portions 22 and 24 respectively and an intermediate portion 25 disposed between the end portions. In the embodiment shown, the flexible member is made of conventional one-inch wide polyethylene webbing commonly used on devices such as life jackets and the like. It has been found that if the harness is to be used to restrain a child, the longitudinal member is preferably formed in a thirty-two inch length of polyethylene webbing. This permits the harness to be used with most children.

The first end portion 22 is folded back upon itself to form a loop 26. The loop is permanently formed by sewing a portion 28 of the first end portion 22 onto itself using conventional stitches 30. Preferably, the stitches are formed in a square pattern surrounding an X pattern.

A first unitary strap 32, approximately twenty-five inches long, is connected to the longitudinal member 20. The strap has first and second strap portions 33 and 35 having respective outer end portions 34 and 36. The first and second strap portions are secured to the intermediate portion of the longitudinal member approximately fourteen inches from the loop 26. The first and second strap portions are connected to the longitudinal member by a second set of stitches 38 formed in a square pattern surrounding an X pattern and thus are securely and unadjustably fixed to the longitudinal member such that the first and second strap portions extend transversely to the longitudinal member. The stitches thus act as first connecting means for connecting the first and second strap portions to the intermediate portion of the longitudinal member.

The first and second outer end portions 34 and 36 are fitted with complementary halves of a conventional strap connector such as a standard side release buckle available from Anchor Marine and Canvas of North Vancouver, British Columbia, Canada. In FIG. 2, a female portion of the standard side release buckle is shown at 40 and a male portion of the buckle is shown at 42. The male and female portions cooperate to act as second connecting means for connecting the first and second outer end portions 34 and 36 together. The male portion 42 has a conventional slidable buckle/strap fastener 44 for permitting adjustment of the connector relative to the end portion to which it is connected to permit adjustment of the tightness of the first and second strap portions about the child.

A second unitary strap 46, approximately twenty-five inches long, and having third and fourth strap portions 37 and 39 respectively is connected to the longitudinal member 20 between the first strap portion 32 and the second end portion 24 of the longitudinal member by a FAST-TAB (trademark) slidable connector 47 (available from Anchor Marine and Canvas of North Vancouver, British Columbia, Canada.

The slidable connector 47 is a generally square piece of plastic having four elongated slots 49 arranged in a square pattern. The longitudinal member 20 is threaded through two longitudinally opposite elongated slots 49.1 and the second strap is threaded through two transversely opposite elongated slots 49.2 which are adjacent the longitudinally elongated slots 49.1.

The slidable connector 47 adjustably connects the second strap 46 and hence the third and fourth strap portions 37 and 39 to the longitudinal member 20 such that the third and fourth strap portions are adjustable relative to the longitudinal member, in a first direction 48 which is parallel to the longitudinal member 20 to permit placement of the third and fourth strap portions about the chest of the child. The slidable connector further renders the third and fourth strap portions adjustable relative to the longitudinal member in a second direction 50 which is perpendicular, or transverse to the longitudinal member 20 to permit placement of the third and fourth strap portions transversely of the longitudinal member. The ability to slide the third and fourth strap portions in the first and second directions permits them to be adjusted relative to the longitudinal member 20 to ensure that they rest comfortably on the child.

For example, the third and fourth strap portions may be moved in the first direction 48 to permit proper positioning thereof relative to the child's arms and may be moved in the second direction 50 to permit proper positioning about the child's upper torso. The slidable connector 47 thus acts as third connecting means for connecting the third and fourth strap portions to the intermediate portion of the longitudinal member and the slots in the connector act as adjusting means for adjusting the third and fourth strap portions longitudinally and transversely of the intermediate portion.

The third and fourth strap portions 37 and 39 have respective first and second outer end portions 52 and 54 fitted with complementary halves of a conventional strap connector such as a standard side release buckle similar to that described above. A female portion of the standard side release buckle is shown at 56 and a male portion of the buckle is shown at 58. The male and female portions cooperate to act as connecting means for connecting the first and second end portions 52 and 54 together. The male portion has a conventional buckle/strap fastener 60 for permitting adjustment of the connector relative to the end portion 54 to permit adjustment of the tightness of the third and fourth strap portions when secured to the child.

A stretchable elastic loop 62 having a connecting portion 63 is securely fastened to the second end portion 24 of the longitudinal member 20 by a third set of stitches 64 formed in a square pattern surrounding an X pattern. The loop is secured to the end portion such that the loop tends to extend in a plane 65 perpendicular to the longitudinal member 20.

Figure 3:
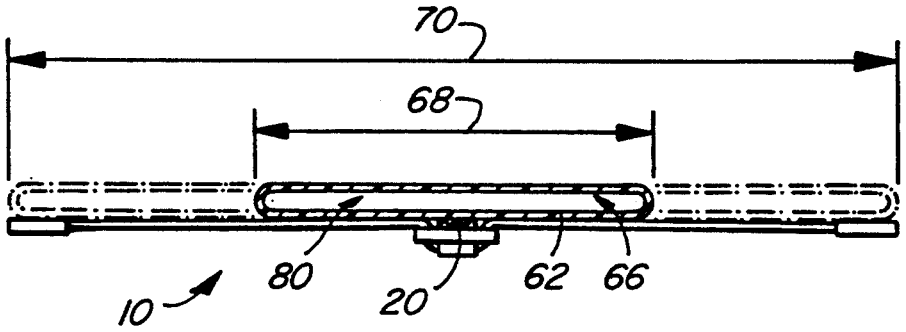
FIG. 3 is cross-sectional view of the harness of FIG. 1 taken along lines 3—3 of FIG. 2.

Referring to FIG. 3, the stretchable elastic loop 62 is formed from a two-inch wide portion of flexible polyester braided elastic material, available from Belding Corticelli Inc. of Toronto, Ontario, Canada. The material is formed into a closed elastic loop shown generally at 66. The loop has first and second co-terminus openings 80 and 82 extending therethrough which permit an object to pass unobstructed through the loop. When the elastic loop 66 is in a relaxed and compressed state i.e. it is not stretched and opposite portions of the loop are laid flat, one upon the other, the loop has a relaxed diameter 68 measuring twelve inches. Using the braided elastic material specified above, when the elastic loop 66 is stretched out, into the position shown in broken outline, i.e opposite ends of the loop are pulled apart, the loop has a stretch diameter 70 measuring twenty-seven inches.

It will be appreciated that the elastic loop 66 may be stretched such that items of various shapes may be passed through the loop and may be securely held therein by virtue of the inherent elasticity of the loop material which causes the loop to embrace such item. Thus, the elastic loop 66 may be used to secure the harness 10 to items of various shapes and more particularly may be used to secure the harness to chairs having uniquely shaped back portions which act as upstanding supports for the longitudinal member 20 of the harness. The harness 10 is thus rendered quite readily adaptable to be secured to a wide range of chairs, while providing easy removal of the harness from such chairs. The harness 10 may be removed simply by stretching the loop and removing it from the item to which it is secured.

OPERATION

The operation of the apparatus according to the first embodiment will be explained in the context of securing a child to a chair. It should be borne in mind however, that the harness may be used to secure objects other than children to any support around which the elastic loop 66 may be secured. It is envisaged that the harness be secured to an upstanding member such as a back portion of a chair however this is a practical limitation in securing a child to a chair and need not be a limitation when securing objects in general to a support member in general (i.e. the support member need not necessarily be a chair).

Figure 4:
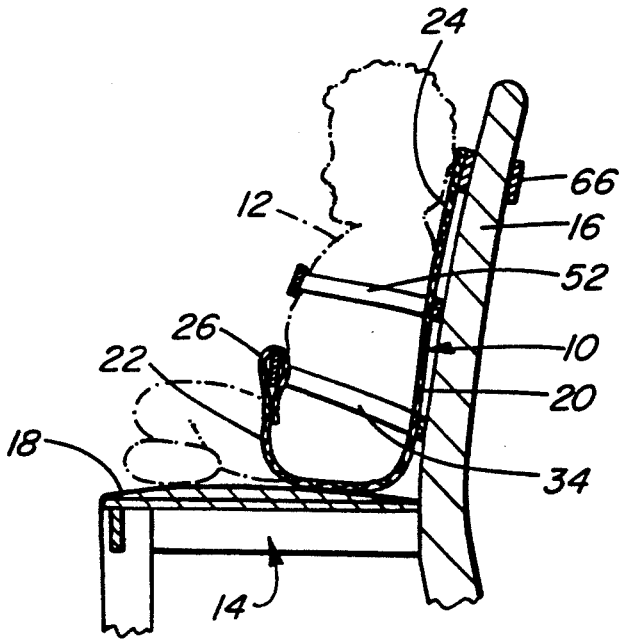
FIG. 4 is a cross-sectional view of the harness of FIG. 1 taken along lines 4—4 of FIG. 1.

Referring to FIG. 4, in using the harness 10 to secure the child 12 to the chair 14, the elastic loop 66 is first looped around the back portion 16 of the chair. The elastic loop is positioned on the chair such that the longitudinal member 20 hangs downward over the seat portion of the chair. For the securing of most children, the elastic loop 66 may be placed at the expected approximate height of the child's head.

The first end portion 22 of the longitudinal member 20 is then placed on the seat portion 18 of the chair such that it rests approximately centrally thereon. The child 12 is then placed on the seat portion 18 such that the longitudinal member is disposed between the seat portion and the child wherein the first end portion 22 extends between the child's legs. The first end portion 22 is then brought upwards between the child's legs such that the loop 26 in the first end portion 22 is in front of the child.

Figure 5:
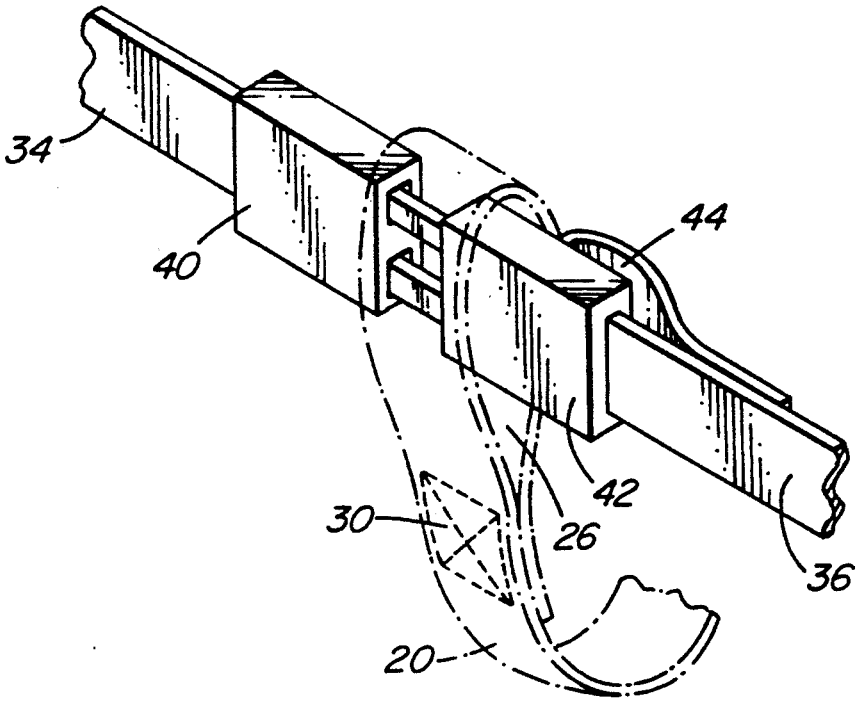
FIG. 5 is an oblique view of male and female portions of a connector on first and second strap portions of the harness, the male and female portions being shown threaded through a loop in a first end portion of a longitudinal member of the harness, the loop and first end portion being shown in broken outline.

Next, the first and second strap portions 33 and 35 of the first strap 32 are wrapped around the child's waist and brought in front of the child. Referring to FIG. 5, the female portion 40 of the strap connector is then threaded through the loop 26 (shown in broken outline). The female portion is then connected to the male portion 42, thereby connecting together the end portions 34 and 36 and the first end portion 22 of the longitudinal member. The first adjustment provision 44 on the connector 42 may then be adjusted to secure the first strap portion about the child with any desired degree of tightness. By threading the female portion 40 through the loop 26, the first end portion 22 of the longitudinal member 20 is connected to the first and second portions strap 33 and 35. The loop 26 thus acts as connecting means for connecting the first end portion of the longitudinal member to the first and second strap portions. A cradle is thus formed about the waist and crotch of the child.

Next, referring to FIG. 1, the third and fourth strap portions 37 and 39 are wrapped around the upper torso of the child. The slidable connector 47 is used to slide the second strap portion relative to the longitudinal member, in the first direction 48, to place the second strap portion in a desired location relative to the child, such as in a position wherein the third and fourth strap portions 37 and 39 extend just beneath the arms of the child. The female and male connector portions 56 and 58 are then connected together to secure the third and fourth strap portions about the child. The buckle/strap fastener 60 may then be used to adjust the tightness of the third and fourth strap portions about the child and the slidable connector 47 may be used to slide the third and fourth strap portions in the second direction 50 to position the connector portions 56 and 58 in a position comfortable to the child. The child is thus comfortably restrained in the chair and is prevented, by the harness, from falling forward and from falling to either side of the seat portion of the chair.

Removal of the child from the harness may be achieved by performing the above steps in the reverse order.

In the event of an emergency, the child need not be removed from the harness, but rather may remain fastened in the harness by the first and second straps and the first end portion. The child may be removed from danger by stretching the elastic loop 66 and pulling it off of the back portion 16 of the chair whereupon the harness may be used as a conventional child restraint device in the event that the child can walk, or the harness may simply be gathered in an adult's hands if the child is to be carried.

It will be appreciated that the harness is adapted to be comfortable to the child while permitting easy removal of the child from the chair, thereby reducing risk of injury to the child in the event of an emergency.

ALTERNATIVES

Figure 6:
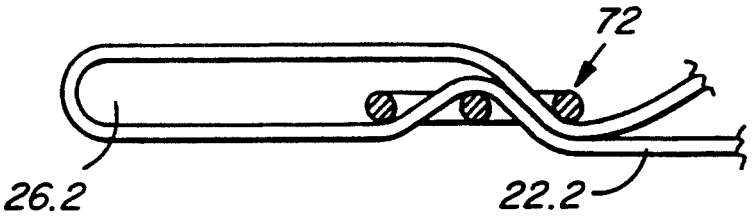
FIG. 6 a cross-sectional view of a conventional strap connector shown connected to a first end portion of a longitudinal member of a harness according to an alternative embodiment of the invention.

Referring to FIG. 6, in an alternative embodiment, the loop 26 is not permanently stitched to the first end portion 22, but rather, an adjustable loop 26.2 is formed in the first end portion 22.2. A conventional strap connector 72 is used to connect a portion of the first end portion 22.2 onto itself. The use of a conventional strap connector permits the size of the loop 26.2 to be adjusted such that the first end portion 22.2 may be tightened as desired upon the crotch of the child.

Referring to FIG. 2, in an alternative embodiment, the stitches 38 connecting the first strap portion 32 to the longitudinal member 20 may be replaced by a second slidable connector (not shown), similar to the first slidable connector 47 used to connect the second strap portion 46 to the longitudinal member 20. This second slidable connector may be used either alone or in conjunction with the connector 72 referred to in FIG. 6, as a means for adjusting the distance between the loop 26 and the first and second end portions thereby providing the capability of adjusting the tightness of the first end portion 22 about the crotch of the child.

The embodiments disclosed are illustrative of the invention only and are not to be construed as limiting the invention as construed in accordance with the accompanying claims.

What is claimed is:

1. A harness for securing an object to a support, the harness comprising:

a) a flexible longitudinal strap member having first and second opposite end portions and an intermediate portion between said end portions;

b) first and second strap portions having respective outer end portions, said first and second strap portions extending transversely to said longitudinal member;

c) first connecting means for connecting said first and second strap portions to said intermediate portion of said longitudinal member;

d) second connecting means for connecting respective outer end portions of said first and second strap portions together and to said first end portion of said longitudinal member;

e) third and fourth strap portions having respective outer end portions, said third and fourth strap portions extending transversely to said longitudinal member;

f) third connecting means for adjustably connecting said third and fourth strap portions to said intermediate portion of said longitudinal member such that said third and fourth strap portions are continuously moveable longitudinally along the longitudinal member, toward or away from the first and second strap portions;

g) fourth connecting means for connecting together respective outer end portions of said third and fourth strap portions;

h) a stretchable elastic loop connected to said second end portion of said longitudinal member said loop having first and second unobstructed co-terminus openings operable to receive said support therein such that said support extends through said loop and is embraced by said loop.

2. A harness as claimed in claim 1 wherein said first connecting means unadjustably fixes said first and second strap portions to said intermediate portion of said longitudinal member.

3. A harness as claimed in claim 2 wherein said first connecting means includes a plurality of stitches for securing said first and second strap portions to said intermediate portion.

4. A harness as claimed in claim 1 wherein the second connecting means includes respective complementary portions of a first releasable connector.

5. A harness as claimed in claim 4 wherein at least one of said complementary portions includes first adjusting means for adjustably connecting said at least one of said complementary portions to an outer end portion of one of said first and second strap portions to permit the tightness of the first and second strap portions to be adjusted about the object.

6. A harness as claimed in claim 4 wherein said second connecting means includes a loop formed in said first end portion of said longitudinal member, said loop being of sufficient size to permit said first releasable connector to pass therethrough.

7. A harness as claimed in claim 6 wherein the harness includes second adjusting means for adjusting the distance between said loop and said first and second strap portions to permit the first end portion to be comfortably secured on a child.

8. A harness as claimed in claim 1 wherein said first and second strap portions and said first end portion of said longitudinal member form a cradle securable about the waist and crotch of a child.

9. A harness as claimed in claim 1 wherein said third connecting means further includes second adjusting means for adjusting the position of the end portions of said third and fourth strap portions transversely relative to said longitudinal member.

10. A harness as claimed in claim 1 wherein said third and fourth strap portions are formed from a single unitary strap member.

11. A harness as claimed in claim 10 wherein said third connecting means includes a slidable connector having elongated slots including at least two longitudinally opposite slots and at least two transversely opposite slots arranged in a square pattern, the intermediate portion of said longitudinal member being threaded through said longitudinally opposite slots and said unitary strap member being threaded through said transversely opposite slots to permit longitudinal and transverse adjustment of said third and fourth strap portions relative to said longitudinal member.

12. A harness as claimed in claim 1 wherein the fourth connecting means includes complementary portions of a second releasable connector.

13. A harness as claimed in claim 12 wherein at least one of said complementary portions includes second adjusting means for adjustably connecting said at least one of said third and fourth strap portions to an outer end portion of one of said third and fourth strap portions to permit the tightness of the third and fourth strap portions to be adjusted about the object.

14. A harness as claimed in claim 1 wherein said elastic loop is formed from a band of flexible polyester braided elastic material.

15. A harness as claimed in claim 1 wherein said elastic loop has a connecting portion which is securely fastened to said longitudinal member such that said loop tends to extend in a plane generally perpendicular to said longitudinal member.

16. A method of harnessing a child in a chair, the method comprising the steps of:

a) passing a back portion of said chair through an unobstructed opening in an elastic loop secured to a longitudinal strap member such that said elastic loop embraces said back portion of said chair;

b) placing an end portion of said longitudinal strap member on a seat portion of said chair;

c) placing said child on said seat portion such that said end portion is disposed between said seat portion and said child;

d) moving said end portion upwards between the child's legs;

e) wrapping first and second transversely extending strap portions of said harness around the waist of said child;

f) connecting together said first and second strap portions and the upwardly extending end portion of the longitudinal strap member;

g) wrapping third and fourth transversely extending strap portions of said harness around the upper torso of the child and connecting together end portions of said third and fourth transversely extending strap portions; and h) sliding said third and fourth strap portions longitudinally along the longitudinal member toward or away from the first and second strap portions to position the third and fourth strap portions comfortably about the child.

17. A method as claimed in claim 16 further including the steps of adjusting the first and second strap portions and adjusting the third and fourth strap portions to a desired degree of tightness on the child.

18. In combination:

a) a chair having a back portion and a seat portion; and b) a harness having:

i) a flexible longitudinal strap member having first and second opposite end portions and an intermediate portion between said end portions;

ii) first and second strap portions having outer end portions, said first and second strap portions extending transversely to said longitudinal member;

iii) first connecting means for connecting said first and second strap portions to said intermediate portion of said longitudinal member;

iv) second connecting means for connecting respective outer end portions of said first and second strap portions together and to said first end portion of said longitudinal member;

v) third and fourth strap portions having respective outer end portions, said third and fourth strap portions extending transversely to said longitudinal member;

vi) third connecting means for adjustably connecting said third and fourth strap portions to said intermediate portion of said longitudinal member such that said third and fourth strap portions are continuously moveable longitudinally along the longitudinal member, toward or away from the first and second strap portions;

vii) fourth connecting means for connecting together respective outer end portions of said third and fourth strap portions;

viii) a stretchable elastic loop connected to said second end portion of said longitudinal member said loop having first and second unobstructed co-terminus openings operable to receive said back portion of said chair therein such that said back portion extends through said loop and is embraced by said loop.

* * * * *